US007475565B2

(12) United States Patent
Esslinger

(10) Patent No.: US 7,475,565 B2
(45) Date of Patent: Jan. 13, 2009

(54) REFRIGERATION SYSTEM INCLUDING A SIDE-LOAD SUB-COOLER

(75) Inventor: Steve Esslinger, Ramsey, MN (US)

(73) Assignee: Zero Zone, Inc., North Prairie, WI (US)

( * ) Notice: Subject to any disclaimer, the term of this patent is extended or adjusted under 35 U.S.C. 154(b) by 564 days.

(21) Appl. No.: 11/213,268

(22) Filed: Aug. 26, 2005

(65) Prior Publication Data

US 2006/0042311 A1 Mar. 2, 2006

Related U.S. Application Data

(60) Provisional application No. 60/604,908, filed on Aug. 27, 2004.

(51) Int. Cl.
*F25B 41/00* (2006.01)

(52) U.S. Cl. ..... 62/513; 62/113

(58) Field of Classification Search ..... 62/513, 62/509, 498, 113, 117, 115, 510

See application file for complete search history.

(56) References Cited

U.S. PATENT DOCUMENTS 4,577,468 A * 3/1986 Nunn et al. ..... 62/113
5,768,901 A * 6/1998 Dormer et al. ..... 62/175
6,138,467 A * 10/2000 Lifson et al. ..... 62/217
6,820,434 B1 * 11/2004 Gutheim et al. ..... 62/175

* cited by examiner

*Primary Examiner*—Chen-Wen Jiang
(74) *Attorney, Agent, or Firm*—Michael Best & Friedrich LLP

(57) ABSTRACT

A refrigeration system includes a compressor operable to produce a flow of compressed refrigerant. The refrigeration system includes a flow splitter positioned to split the flow of compressed refrigerant into a first flow that flows along a first flow path and a second flow that flows along a second flow path. An expansion device is positioned in the second flow path and is operable to reduce the temperature of the second flow. A heat exchanger has a first side that receives the first flow and a second side that receives the second flow such that the second flow cools the first flow.

27 Claims, 2 Drawing Sheets

REFRIGERATION SYSTEM INCLUDING A SIDE-LOAD SUB-COOLER

RELATED APPLICATION DATA

This application claims benefit under 35 U.S.C. Section 119(e) of co-pending U.S. Provisional Application No. 60/604,908 filed Aug. 27, 2004, which is fully incorporated herein by reference.

BACKGROUND

The present invention relates to a refrigeration system that includes a sub-cooler. More particularly, the present invention relates to a refrigeration system that includes a sub-cooler positioned to cool refrigerant before it is delivered to an evaporator.

Compressor racks including multiple compressors of the same or differing sizes are often employed in large applications such as supermarkets or refrigerated warehouses. The compressors compress refrigerant that passes through one or more evaporators to cool spaces. Generally, the compressors cycle to provide the needed quantity of compressed refrigerant for the system. As such, the energy required to power the compressors represents a significant cost in operating the refrigeration system. In addition, cycling and operation of the compressors can produce wear that increases the maintenance requirements for the compressors and can result in system down time that can be costly or undesirable.

SUMMARY

In one embodiment, the invention provides a refrigeration system that includes a compressor operable to produce a flow of compressed refrigerant. The refrigeration system includes a flow splitter positioned to split the flow of compressed refrigerant into a first flow that flows along a first flow path and a second flow that flows along a second flow path. An expansion device is positioned in the second flow path and is operable to reduce the temperature of the second flow. A heat exchanger has a first side that receives the first flow and a second side that receives the second flow such that the second flow cools the first flow.

In another embodiment, the invention provides a refrigeration system including an evaporator positioned to cool a space. The refrigeration system includes a suction header having a suction pressure and a compressor operable to draw refrigerant from the suction header and discharge compressed refrigerant. A heat exchanger at least partially defines a first flow path and a second flow path. The first flow path directs refrigerant from the compressor through the heat exchanger to the evaporator, and the second flow path directs refrigerant from the compressor through the heat exchanger to the suction header. A valve is movable between a first position in which all of the refrigerant enters the first flow path to a second position in which a portion of the refrigerant enters the second flow path and the remainder of the refrigerant enters the first flow path.

In yet another embodiment, the invention provides a refrigeration system that includes a suction header having a suction pressure, an evaporator, and a discharge path that provides fluid communication between the evaporator and the suction header. A compressor is operable to draw refrigerant from the suction header and produce a flow of refrigerant. A heat exchanger has a first side that defines a first inlet and a first outlet and a second side that defines a second inlet and a second outlet. A first flow path has a first portion that provides fluid communication between the compressor and the first inlet and a second portion that provides fluid communication between the first outlet and the evaporator. A second flow path has a first portion that provides fluid communication between the first portion of the first flow path and the second inlet and a second portion that provides fluid communication between the second outlet and the suction header. An expansion device is positioned in the first portion of the second flow path and a control valve is movable between an open position and a closed position in response to at least the suction pressure.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
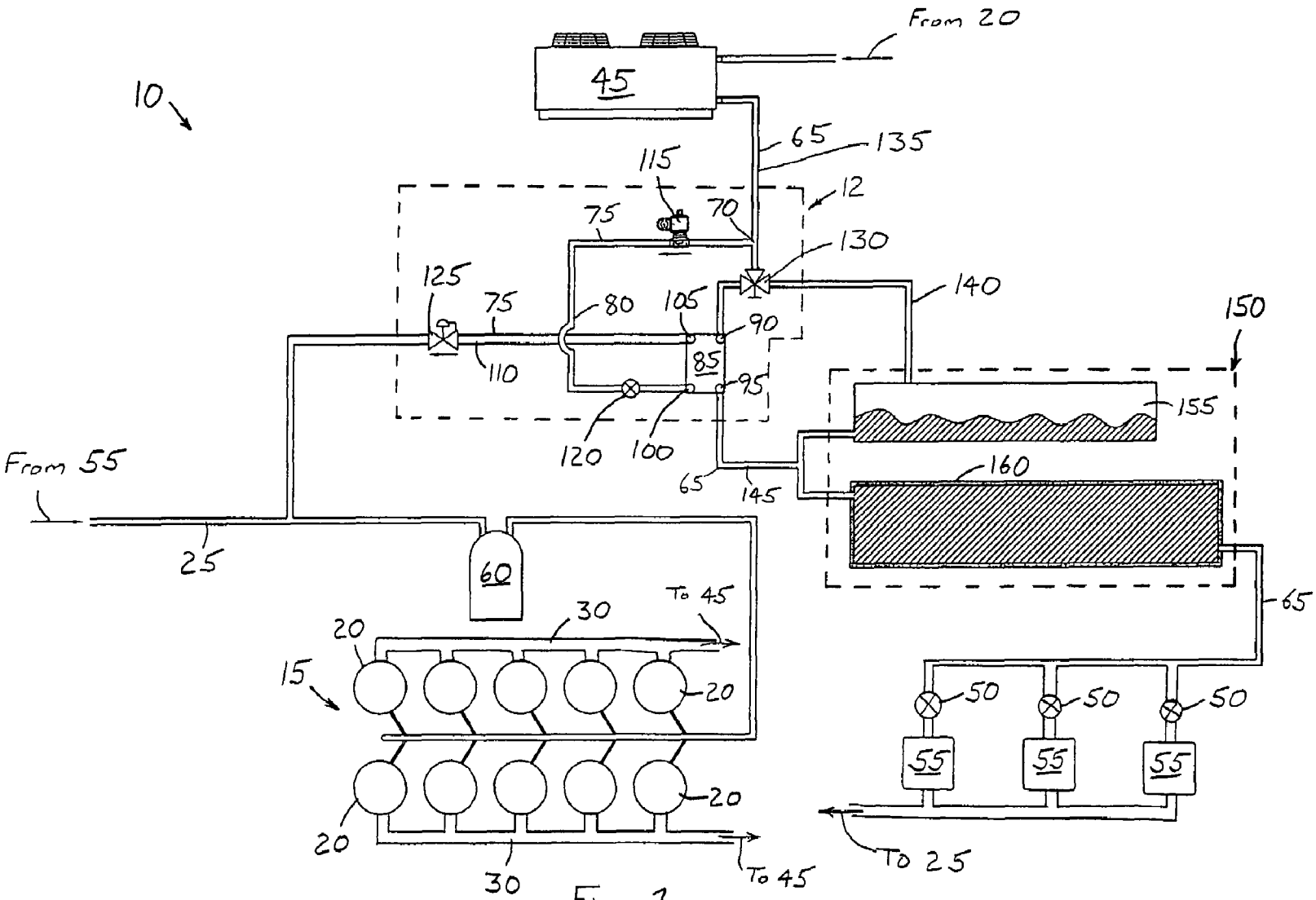
FIG. 1 is a schematic representation of a portion of a refrigeration system according to the present invention.

FIG. 1 illustrates a refrigeration system 10 that includes a side-loaded sub-cooler 12. Refrigeration systems 10 of this type are well-suited for use in large supermarkets or warehouse applications. The system 10 includes a bank of compressors 15 arranged in parallel such that each compressor 20 draws refrigerant from a common suction header 25 and discharges compressed refrigerant to a common discharge header 30. In some constructions, oil-flooded compressors, such as oil-flooded screw compressors are employed to compress the refrigerant. In these constructions, other components such as oil separators 35 (shown in FIG. 2), oil filters 40, flow controls and the like may be employed in the system 10. Of course other types of compressors 20 could also be employed if desired.

In preferred constructions, the refrigeration system 10 employs similarly sized compressors 20. For example, one construction may employ ten compressors 20 each powered by a ten horsepower motor. The use of similarly sized or even identical compressors 20 (i.e., same make, model, and size) simplifies assembly of the system 10, control of the system 10, and maintenance of the system 10. Of course other constructions may employ differently sized compressors if desired. In addition, different makes, models, or even designs (e.g., screw, reciprocating, centrifugal, scroll, etc.) may be combined in a bank of compressors 15 if desired.

A condenser 45 receives compressed refrigerant from the discharge header 30 and operates to cool and condense the refrigerant into a liquid or saturated liquid/vapor combination. In most constructions a single large condenser 45 is positioned outside of the facility employing the refrigeration system 10. For example, the condenser 45 is often positioned on a roof top or behind the building employing the refrigeration system 10. The condenser 45 includes a heat exchanger and a fan that moves air across the heat exchanger to cool the refrigerant. In most constructions, a finned-tube heat exchanger is employed with refrigerant flowing through the tubes and the air moving across the fins. Often, a fan or other fluid moving device moves the air or other fluid past the fins and improve the cooling efficiency of the condenser 45. Of course, other types of heat exchangers could be employed if desired. In addition, while a single condenser 45 is illustrated, some constructions may employ multiple condensers 45 that operate in parallel or in series as may be necessary for the particular application.

With continued reference to FIG. 1, the refrigeration system 10 also includes an expansion device 50 and an evaporator 55. The expansion device 50 generally includes a thermal expansion valve that reduces the temperature and pressure of refrigerant that flows through the valve. The reduced temperature refrigerant flows into the evaporator 55 to cool an associated space as is known in the art of refrigeration. Like the condenser 45, the evaporator 55 includes a heat exchanger that receives the cool refrigerant and uses the cool refrigerant to cool air or another fluid. The heat exchanger is typically a finned-tube heat exchanger with refrigerant flowing within the tubes and air flowing over the fins. Of course other types of heat exchangers could be employed if desired. Often, a fan or other fluid moving device is employed to move the air or other fluid past the fins and improve the cooling efficiency of the evaporator 55.

It should be noted that while FIG. 1 illustrates three expansion devices 50 and three evaporators 55, other constructions may include more or fewer expansion devices 50 associated with more or fewer evaporators 55. This arrangement allows the refrigeration system 10 to cool multiple spaces substantially independent of one another. In these constructions, each evaporator 55 could be associated with a separate space (e.g., multiple display cases) or could work together with other evaporators 55 to cool a single large space or multiple large spaces.

Refrigerant leaving the evaporator 55 or evaporators 55 is directed back to the suction header 25 and the cycle is repeated. In some constructions, an accumulator 60 is positioned in the suction header 25 to collect and hold excess refrigerant. The accumulator 60 also assures that sufficient refrigerant can be entrained within the refrigeration system 10 to assure sufficient refrigerant is available during peak demand times and yet allow the system 10 to use a lesser amount of refrigerant during low demand periods.

A first flow path 65 extends between the condenser 45 and the evaporator 55. More specifically, refrigerant exits the condenser 45 and enters the first flow path 65. A flow splitter 70 is positioned within the first flow path 65 to direct a portion of the refrigerant along a second flow path 75 with the remainder of the refrigerant continuing along the first flow path 65. The flow splitter 70 can include a valve or other mechanical device or may be as simple as a "T" or a "Y" in the pipes that define the first flow path 65. Alternatively, the second flow path 75 could extend directly from the outlet of the condenser 45 such that the inlet of the first flow path 65 and the inlet of the second flow path 75 are adjacent one another. In such an arrangement, the two inlets should be considered part of the first flow path 65.

The second flow path 75 includes a first portion 80 that extends from the first flow path 65 to a heat exchanger 85. The heat exchanger 85 defines a portion of the sub-cooler 12 and includes a first side that defines an inlet 90 and an outlet 95 and a second side that defines an inlet 100 and an outlet 105. The first portion 80 of the second flow path 75 extends to the inlet 100 of the second side of the heat exchanger 85. The second flow path 75 also includes a second portion 110 that extends from the outlet 105 of the second side of the heat exchanger 85 to the suction header 25. Thus, the second side of the heat exchanger 85 at least partially defines the second flow path 75.

In preferred constructions, the heat exchanger 85, or sub-cooler, includes a plate-to-plate heat exchanger. However, other constructions may employ other types of heat exchangers. For example, another construction may employ a shell and tube heat exchanger.

The first portion 80 of the second flow path 75 also includes a solenoid valve 115 that is movable between a first or open position and a second or closed position. When closed, no refrigerant is able to flow through the second flow path 75. An expansion device 120 such as a thermal expansion valve is also positioned within the first portion 80 of the second flow path 75 to allow the refrigerant flowing in the second flow path 75 to expand and cool. Thus, as the refrigerant enters the heat exchanger 85, the refrigerant is substantially cooler than the refrigerant in the first flow path 65. An evaporator pressure regulating valve 125 is positioned in the second portion 110 of the second flow path 75 and is configured to maintain the pressure within the first portion 80 of the second flow path 75 at or above a predetermined pressure.

With continued reference to FIG. 1, the first flow path 65 includes a three-way valve 130 that is movable between a first position in which refrigerant flows along a first portion 135 of the first flow path 65 and a second position in which refrigerant flows along a bypass flow path 140. With the three-way valve 130 in the first position, the refrigerant flows along the first portion 135 of the first flow path 65 to the inlet 90 of the first side of the heat exchanger 85. A second portion 145 of the first flow path 65 extends from the outlet 95 of the first side of the heat exchanger 85 to the evaporator 55 or evaporators 55. Thus, the first side of the heat exchanger 85 at least partially defines the first flow path 65. The bypass flow path 140 is arranged to direct refrigerant from the first portion 135 of the first flow path 65 to the second portion 145 of the first flow path 65 without passing through the heat exchanger 85.

In preferred constructions, the flow splitter 70, the heat exchanger 85, the solenoid valve 115, the expansion device 120, the evaporator pressure regulating valve 125, and the three-way valve cooperate to define the sub-cooler 12. Of course, other constructions may include additional components or may omit certain components as required by the system.

A receiver 150 is positioned in the second portion 145 of the first flow path 65 to receive and hold refrigerant for use in the evaporator 55 or evaporators 55. As illustrated in FIG. 1, the receiver 150 includes a primary receiver tank 155 and a secondary receiver tank 160. In preferred constructions, each receiver tank 155, 160 is a fabricated steel structure that is insulated to maintain the temperature of the refrigerant contained therein. Of course other constructions or other materials could be employed if desired. The secondary receiver tank 160 is arranged such that only liquid refrigerant flows into the tank 160. Thus, there is no vapor-liquid boundary in the secondary tank 160. The elimination of this boundary improves the insulative properties of the tank 160 and better maintains the temperature of the liquid within the secondary receiver tank 160. The primary receiver tank 155 contains both liquid and vapor and as such includes a vapor-liquid boundary. Of course, other constructions may include a receiver 150 that includes only one tank (as shown in FIG. 2), or more than two tanks if desired.

Figure 2:
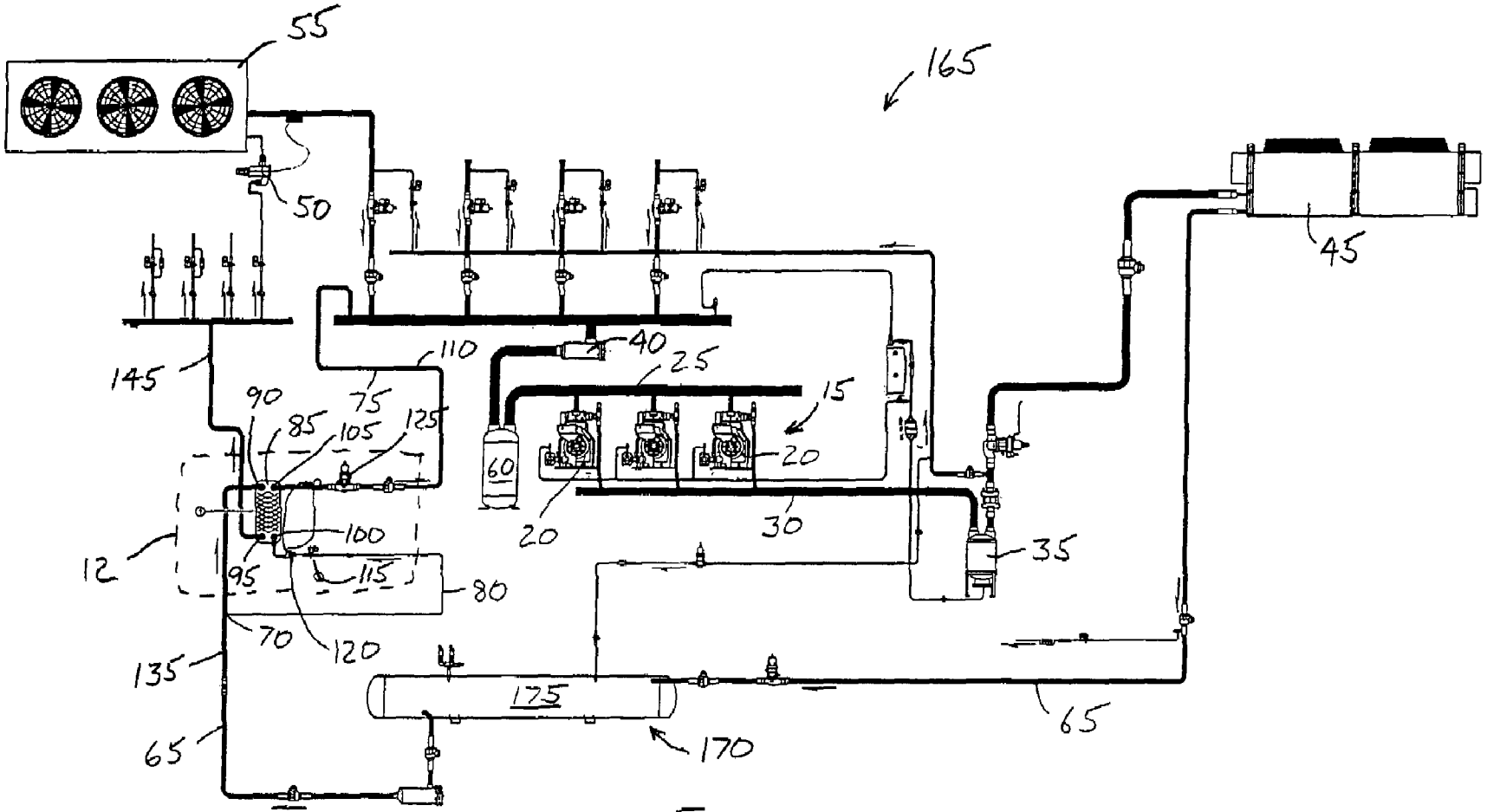
FIG. 2 is a schematic representation of a portion of another refrigeration system according to the present invention.

FIG. 2 illustrates another refrigeration system 165 in which a receiver 170 is positioned between the condenser 45 and the heat exchanger 85 rather than between the heat exchanger 85 and the evaporator 55 as illustrated in FIG. 1. Generally, a single receiver tank 175 is sufficient in the construction of FIG. 2 as the refrigerant is substantially hotter than the surrounding ambient air and is thus cooled by the air, which would be desirable. Of course, two or more receiver tanks 175 could be employed if desired.

In operation and with reference to FIG. 1, one or more of the compressors 20 operate as required by the system 10 to produce a flow of compressed refrigerant. The flow of compressed refrigerant flows to the condenser 45 and is cooled until it condenses to a liquid that flows to the splitter 70. Generally, when the solenoid valve 115 is closed, the three-way valve 130 is in the second position. With the valves 115, 130 configured in this manner, no refrigerant enters the second flow path 75 and all of the refrigerant passes through the bypass flow path 140 directly to the receiver 150.

During operating periods when the solenoid valve 115 is in the open position, the three-way valve 130 is generally in the first position. When arranged in this manner, a portion of the refrigerant leaving the condenser 45 enters the second flow path 75 at the splitter 70 and the remainder of the refrigerant follows the first flow path 65 through the heat exchanger 85 to the receiver 150. The portion of refrigerant flowing along the second flow path 75 passes through the thermal expansion valve 120 and cools such that it is able to cool the refrigerant in the first flow path 65 before it enters the receiver 150.

From the receiver 150, the refrigerant is distributed to the various thermal expansion valves 50 and evaporators 55 as required to cool the associated spaces. After passing through the evaporators 55, the refrigerant returns to the suction header 25 and the cycle repeats.

The heat exchanger 85, or sub-cooler, is sized to pass the output flow produced by at least one compressor 20. After passing through the heat exchanger 85, this flow returns to the suction header 25, thereby increasing the suction pressure and the quantity of refrigerant within the suction header 25. In addition, under desired operating conditions, the refrigerant flowing through the second flow path 75 is able to cool the flow in the first flow path 65 by about 30 degrees Fahrenheit. For each 10 degrees F. of cooling, the mass flow of refrigerant required by the refrigeration system 10 can be reduced by about 11 percent. Thus, a 30 degree F. drop in temperature results in a corresponding reduction in mass flow through the refrigeration system 10 of one-third.

Thus, the heat exchanger 85 acts as a "flywheel" in that it stores excess capacity when the compressors 20 provide excess refrigerant, and supplies capacity to reduce the work output required by the compressors 20 during other operating periods. For example, the heat exchanger 85 can be used to allow one or more compressors 20 to remain idle for a longer period of time. By remaining idle for a longer period of time, the overall energy consumption of the refrigeration system 10 is reduced.

Furthermore, the increased suction pressure at the suction header 25 that results during operation of the heat exchanger 85 reduces the compression ratio of the compressors 20, thus reducing the work required by the compressors 20 to achieve the desired discharge pressure and saving additional energy.

In preferred constructions, a pressure sensor (not shown) measures the suction pressure in the suction header 25 and initiates actuation of the solenoid valve 115 and movement of the three-way valve 130 to the second position in response to a suction pressure below a predefined value. In still other constructions, the discharge temperature of the receiver 150 is monitored (e.g., thermocouple) and used in conjunction with the measured suction pressure to actuate the solenoid valve 115 and move the three-way valve 130. In these constructions, a suction pressure below a predefined value and a discharge temperature above a predetermined value are required to actuate the solenoid valve 115 and move the three-way valve 130 to direct flow through the heat exchanger 85.

Although the invention has been described in detail with reference to certain described constructions, variations and modifications exist within the scope and spirit of the invention.

What is claimed is:

1. A refrigeration system including a compressor operable to produce a flow of compressed refrigerant, the refrigeration system comprising:

a flow splitter positioned to split the flow of compressed refrigerant into a first flow that flows along a first flow path and a second flow that flows along a second flow path;

an expansion device positioned in the second flow path and operable to reduce the temperature of the second flow;

a heat exchanger having a first side that receives the first flow and a second side that receives the second flow such that the second flow cools the first flow; and a three-way valve positioned in the first flow path and movable between a first position in which the first flow bypasses the first side of the heat exchanger and a second position in which the first flow passes through the first side of the heat exchanger.

2. The refrigeration system of claim 1, further comprising a receiver positioned in the first flow path such that the first flow exits the heat exchanger and flows into the receiver.

3. The refrigeration system of claim 2, further comprising an expansion device and an evaporator positioned in the first flow path to receive refrigerant from the receiver.

4. The refrigeration system of claim 1, further comprising a suction header positioned to receive the first flow from the first flow path and the second flow from the second flow path.

5. The refrigeration system of claim 1, further comprising a valve movable between a first position in which no refrigerant flows along the second flow path and a second position in which refrigerant flows along both the first flow path and the second flow path.

6. The refrigeration system of claim 5, further comprising a suction header having a suction pressure, the valve being movable in response to at least a measured suction pressure below a predetermined value.

7. The refrigeration system of claim 6, further comprising a receiver positioned in the first flow path such that the first flow exits the heat exchanger and flows into the receiver, the receiver having an outlet defining a receiver outlet temperature, the valve movable in response to the measured suction pressure below the predetermined value and a measured outlet temperature above a predetermined value.

8. A refrigeration system including a compressor operable to produce a flow of compressed refrigerant, the refrigeration system comprising:

a flow splitter positioned to split the flow of compressed refrigerant into a first flow that flows along a first flow path and a second flow that flows along a second flow path;

an expansion device positioned in the second flow path and operable to reduce the temperature of the second flow;

a heat exchanger having a first side that receives the first flow and a second side that receives the second flow such that the second flow cools the first flow; and a receiver positioned in the first flow path such that the first flow exits the heat exchanger and flows into the receiver, wherein the receiver includes a first receiver tank that collects compressed liquid refrigerant and a second receiver tank that collects compressed liquid refrigerant and compressed vapor refrigerant.

9. A refrigeration system including an evaporator positioned to cool a space, the refrigeration system comprising:

a suction header having a suction pressure;

a compressor operable to draw refrigerant from the suction header and discharge compressed refrigerant;

a heat exchanger at least partially defining a first flow path and a second flow path, the first flow path directing refrigerant from the compressor through the heat exchanger to the evaporator, and the second flow path directing refrigerant from the compressor through the heat exchanger to the suction header;

a valve movable between a first position in which all of the refrigerant enters the first flow path to a second position in which a portion of the refrigerant enters the second flow path and the remainder of the refrigerant enters the first flow path; and a three-way valve positioned in the first flow path and movable between a first position in which the first flow bypasses the first side of the heat exchanger and a second position in which the first flow passes through the first side of the heat exchanger.

10. The refrigeration system of claim 9, further comprising a receiver positioned in the first flow path such that refrigerant exits the heat exchanger and flows into the receiver.

11. The refrigeration system of claim 10, further comprising an expansion device positioned between the receiver and the evaporator.

12. The refrigeration system of claim 9, wherein the valve is movable in response to at least a measured suction pressure below a predetermined value.

13. The refrigeration system of claim 12, further comprising a receiver positioned in the first flow path such that the first flow exits the heat exchanger and flows into the receiver, the receiver having an outlet defining a receiver outlet temperature, the valve movable in response to the measured suction pressure below the predetermined value and a measured outlet temperature above a predetermined value.

14. The refrigeration system of claim 9, wherein the compressor includes a plurality of compressors arranged in parallel.

15. The refrigeration system of claim 14, wherein each of the plurality of compressors is substantially the same size.

16. The refrigeration system of claim 9, wherein refrigerant within the portion of the second flow path defined by the heat exchanger cools refrigerant within the portion of the first flow path defined by the heat exchanger.

17. A refrigeration system including an evaporator positioned to cool a space, the refrigeration system comprising:

a suction header having a suction pressure;

a compressor operable to draw refrigerant from the suction header and discharge compressed refrigerant;

a heat exchanger at least partially defining a first flow path and a second flow path, the first flow path directing refrigerant from the compressor through the heat exchanger to the evaporator, and the second flow path directing refrigerant from the compressor through the heat exchanger to the suction header;

a valve movable between a first position in which all of the refrigerant enters the first flow path to a second position in which a portion of the refrigerant enters the second flow path and the remainder of the refrigerant enters the first flow path; and a receiver positioned in the first flow path such that refrigerant exits the heat exchanger and flows into the receiver, wherein the receiver includes a first receiver tank that collects compressed liquid refrigerant and a second receiver tank that collects compressed liquid refrigerant and compressed vapor refrigerant.

18. A refrigeration system comprising:

a suction header having a suction pressure;

an evaporator;

a discharge path providing fluid communication between the evaporator and the suction header;

a compressor operable to draw refrigerant from the suction header and produce a flow of refrigerant;

a heat exchanger having a first side defining a first inlet and a first outlet and a second side defining a second inlet and a second outlet;

a first flow path having a first portion that provides fluid communication between the compressor and the first inlet and a second portion that provides fluid communication between the first outlet and the evaporator;

a second flow path having a first portion that provides fluid communication between the first portion of the first flow path and the second inlet and a second portion that provides fluid communication between the second outlet and the suction header;

an expansion device positioned in the first portion of the second flow path;

a control valve movable between an open position and a closed position in response to at least the suction pressure; and a three-way valve positioned in the first flow path and movable between a first position in which the first flow bypasses the first side of the heat exchanger and a second position in which the first flow passes through the first side of the heat exchanger.

19. The refrigeration system of claim 18, further comprising a receiver positioned in the first flow path such that refrigerant exiting the first outlet enters the receiver.

20. The refrigeration system of claim 19, further comprising an expansion device positioned between the receiver and the evaporator.

21. The refrigeration system of claim 18, wherein the control valve is positioned in the second flow path and no refrigerant flows along the second flow path when the valve is in the closed position.

22. The refrigeration system of claim 18, wherein the valve is movable in response to at least a measured suction pressure below a predetermined value.

23. The refrigeration system of claim 22, further comprising a receiver positioned in the first flow path such that the first flow exits the heat exchanger and flows into the receiver, the receiver having an outlet defining a receiver outlet temperature, the valve movable in response to the measured suction pressure below the predetermined value and a measured outlet temperature above a predetermined value.

24. The refrigeration system of claim 18, wherein the compressor includes a plurality of compressors arranged in parallel.

25. The refrigeration system of claim 24, wherein each of the plurality of compressors is substantially the same size.

26. The refrigeration system of claim 18, wherein refrigerant within the second side of the heat exchanger cools refrigerant within the first side of the heat exchanger.

27. A refrigeration system comprising:

a suction header having a suction pressure;

an evaporator;

a discharge path providing fluid communication between the evaporator and the suction header;

a compressor operable to draw refrigerant from the suction header and produce a flow of refrigerant;

a heat exchanger having a first side defining a first inlet and a first outlet and a second side defining a second inlet and a second outlet;

a first flow path having a first portion that provides fluid communication between the compressor and the first inlet and a second portion that provides fluid communication between the first outlet and the evaporator;

a second flow path having a first portion that provides fluid communication between the first portion of the first flow path and the second inlet and a second portion that provides fluid communication between the second outlet and the suction header;

an expansion device positioned in the first portion of the second flow path;

a control valve movable between an open position and a closed position in response to at least the suction pressure; and a receiver positioned in the first flow path such that refrigerant exiting the first outlet enters the receiver, wherein the receiver includes a first receiver tank that collects compressed liquid refrigerant and a second receiver tank that collects compressed liquid refrigerant and compressed vapor refrigerant.

* * * * *